United States Patent [19]

Seipenbusch et al.

[11] 4,352,675

[45] Oct. 5, 1982

[54] COAL GASIFICATION REACTOR

[75] Inventors: Jürgen Seipenbusch, Essen; Hans Dohren, Monchen-Gladbach, both of Fed. Rep. of Germany

[73] Assignee: Ruhrkohle Aktiengesellschaft, Essen, Fed. Rep. of Germany

[21] Appl. No.: 98,917

[22] Filed: Nov. 30, 1979

[51] Int. Cl.[3] ..... C10J 3/50

[52] U.S. Cl. ..... 48/73; 48/63; 48/77; 48/86 R; 48/DIG. 7; 110/264; 239/403; 239/465

[58] Field of Search ..... 48/63, 206, 64, 73, 48/77, 87, 86 R, DIG. 7; 239/399, 400, 403, 404, 405, 406, 489, 591, 465, 476; 110/261, 262, 264

[56] References Cited

U.S. PATENT DOCUMENTS

| | | | |
|---|---|---|---|
| 1,881,359 | 10/1932 | Jones | 239/403 |
| 2,076,753 | 4/1937 | Thompson | 239/465 |
| 2,307,694 | 1/1943 | Malke | 239/487 |
| 2,719,056 | 9/1955 | Bettison | 239/403 |
| 2,904,417 | 9/1959 | Nuyl | 48/206 |
| 3,175,817 | 3/1965 | Smith et al. | 239/403 |
| 3,684,186 | 8/1972 | Helmrich | 239/400 |
| 3,972,690 | 8/1976 | Os | 239/405 |
| 3,980,233 | 9/1976 | Simmons et al. | 239/404 |

FOREIGN PATENT DOCUMENTS

| | | | |
|---|---|---|---|
| 479191 | 2/1938 | United Kingdom | 239/403 |
| 518776 | 3/1940 | United Kingdom | 239/487 |

*Primary Examiner*—Peter F. Kratz
*Attorney, Agent, or Firm*—Jon M. Lewis

[57] ABSTRACT

Disclosed is a reactor for gasifying coal including a vortex burner. Helical ribs are arranged in the inner combustion gas supplying conduit of the burner to impart a spiral trajectory to the gas and also the coal-water suspension which suspension is supplied in the annular space between the inner conduit and an outer concentric conduit. Means are provided for adjustably supporting the ribs inside the inner conduit. In addition, other rib supporting arrangements and also burner structure for supplying the coal-water slurry centrally are disclosed.

18 Claims, 13 Drawing Figures

Figure 1:
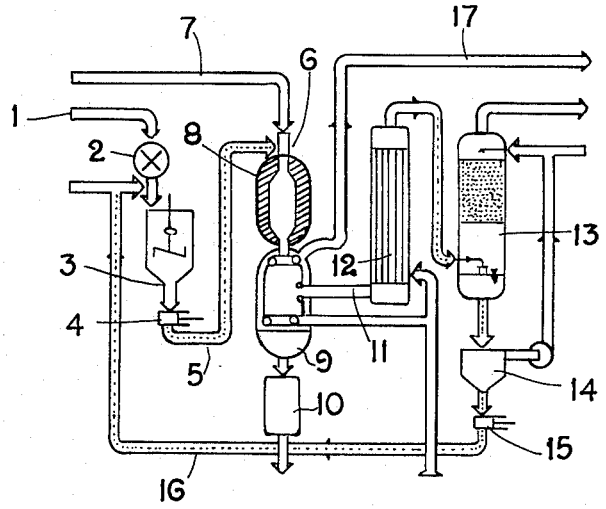

24
21
34
34
20
33
33
32
34
28
31
32
29
25
30
26
22
23
27

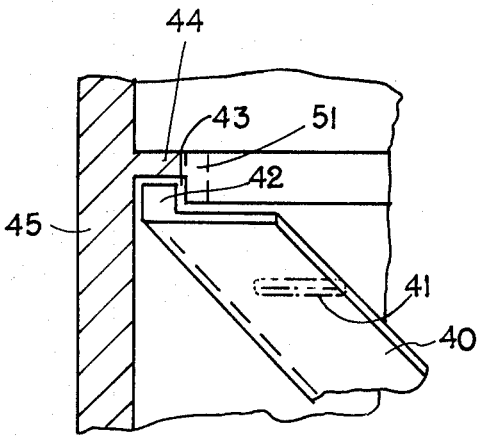
Fig 3
Fig 4
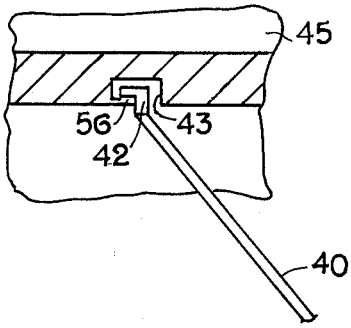
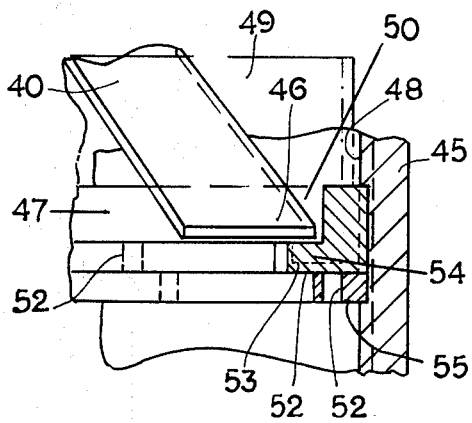
Fig 5

Fig 6
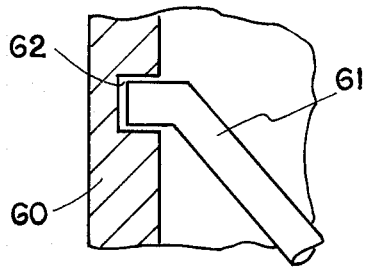
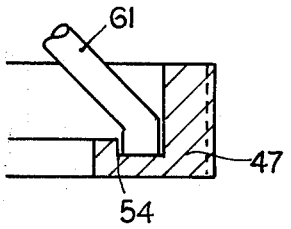
Fig 7
Fig 8
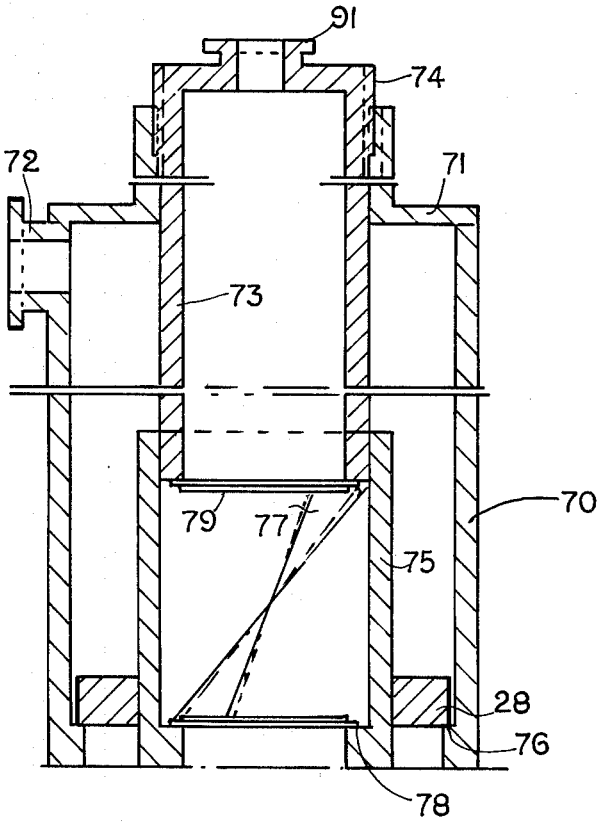

COAL GASIFICATION REACTOR

The invention relates to a reactor for coal gasification process by which is generated, under partial oxidation of a solid material containing coal by addition of water, a carbon monoxide gas and gas containing hydrogen which can be used for synthesis or as combustion gas.

In all coal gasification processes slag is formed which must be taken away from the generated gas stream. This is conveniently achieved by a water bath beneath the reactor. When contacting the surface of the water bath, the fluid slag particles solidify. The solidified slag particles sink in the water bath according to their larger specific weight and collect at the bottom of the water bath or in a lock from which they are extracted intermittently without influence of the water bath.

It occurs, however, often that the slag sinks only partially; e.g., those particles of the falling slag which are floatable collect at the surface of the water bath. On the one hand, this leads to a blocking of the reactor and, on the other hand, to an insufficient elimination of the slag from the generated synthesis gas. The slag particles entrained onto the adjacent installation will cause there, too, an obstruction or a disturbance in the operation.

The invention, therefore, has for object to prevent the formation of floatable slag. Also, according to the invention, it has been conceived that the floatability of slag results from an insufficient combustion in which empty spaces exist due to a particular slag flow. According to the invention an improved combustion is ensured by a longer stay of the solid material in the reactor. Such longer stay is achieved by having the solid material move no longer straight but through a spiralling trajectory through the reactor. The spiralling trajectory causes a circulatory burner in the reactor.

Preferably the gasification materials, for instance coal in water suspension, are fed separately from the combustive air necessary for gasification, for instance oxygen. Such separate conduction makes it possible to cause a differential vortex.

The least abrasive medium is set into rotation; that is to say, the gas supporting combustion, e.g., the oxygen.

When meeting with the materials evolving gases, the air or oxygen stream entrains the gas evolving materials and transmits at least in part its own circular motion to the materials. This occurs directly at the exit from the burner; in the reactor itself the gas evolving materials are agitated; for instance, coal and water take a spiralling trajectory as a result from their rotating motion. This ensures, by a sufficient distance from the wall of the reactor, protection against abrasion by the gas evolving materials in motion through the reactor.

According to the invention the rotating effect is achieved by helical ribs running continuously in the conduit for the gas supporting combustion, or the oxygen. By construction the tube-like conduit is provided with the ribs at the inner wall of the tube. Instead of ribs, guide plates could be inserted.

The ribs are mounted fixedly or movably. With fixed ribs preferably they consist of plates which are curved in the form of a helix and welded.

With movable ribs, spring blades or spring-like wires come into consideration. With movable ribs it is possible to change the inclination and to adjust the pitch to match optimally the operating conditions. For the rib an inclination between 20° and 70° to the longitudinal axis of admission comes into consideration. Preferably, however, the inclination angle is between 45° and 60°. For adjusting the movable ribs, a screw mechanism may be used. Accordingly, the ribs which are resilient or flexible are maintained in placed at one end by tongues and at the other end slide into a peripheral nut pertaining to a leading nut which is adjustable in the longitudinal direction of the conduit. The leading nut allows the necessary change of position for a change in length of the ribs. The change of position results from the forced deformation accompanying a longitudinal adjustment.

As a system for adjusting the movable ribs can be used among others, pressure screws, tension screws, and screw arrangements operable in two directions. Neither the ribs, nor the adjusting system need to be specially devised to withstand heat stresses, since the admitted combustive air, such as oxygen and the materials evolving gases, such as coal-water suspension, have a strong cooling effect on the burner.

In the drawing, several illustrative embodiments of the invention are shown:

FIG. 1 shows schematically a view of the overall gasification installation with a reactor according to the invention.

Figure 2:
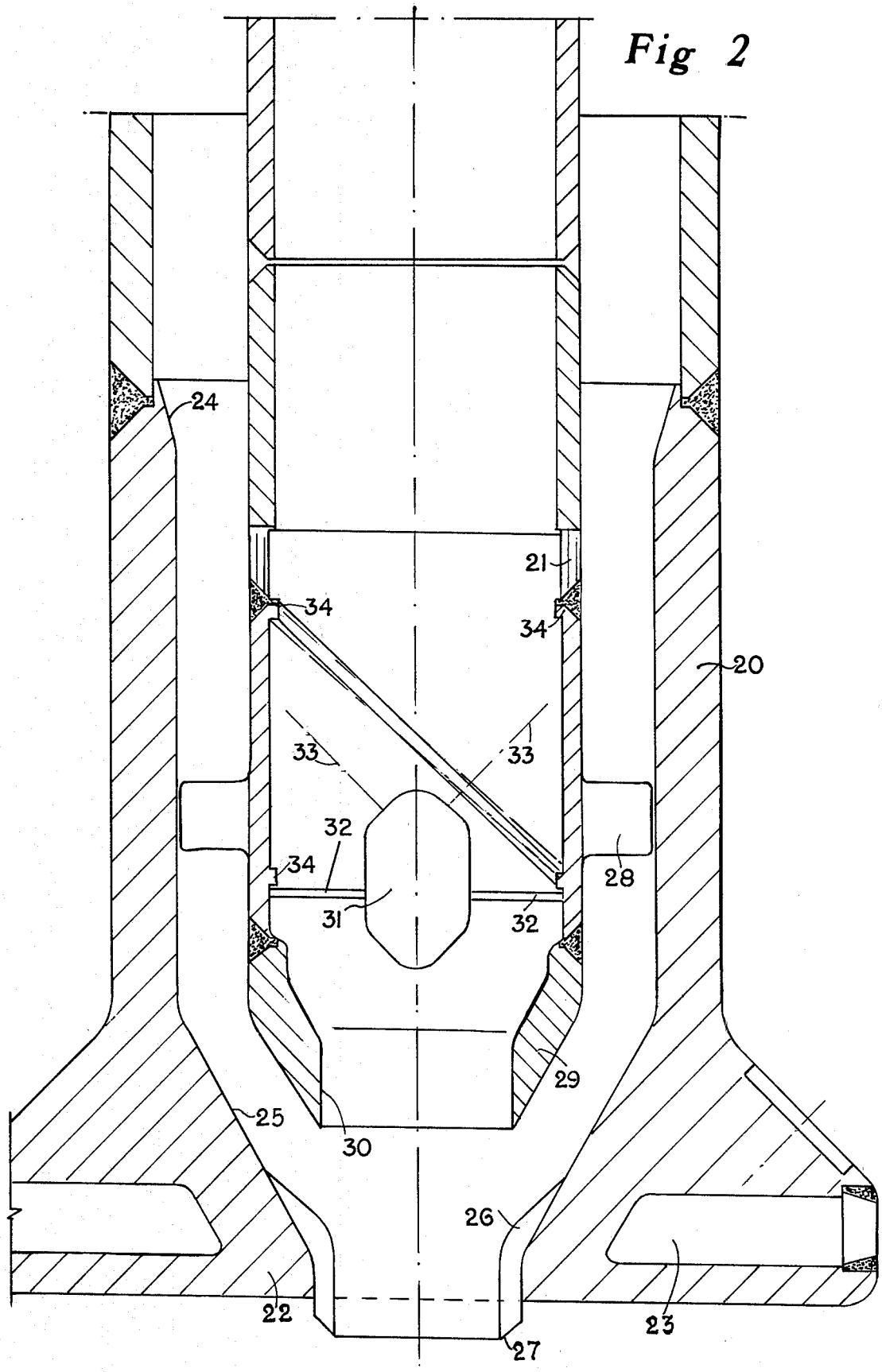

FIG. 2—a vortex burner for a reactor according to FIG. 1.

FIGS. 3–5—cross-sections of another vortex burner for the reactor after FIG. 1.

FIGS. 6 and 7—cross-sections of a third vortex butner for the reactor after FIG. 1.

FIGS. 8–12—a fourth vortex burner for the reactor after FIG. 1.

Figure 13:
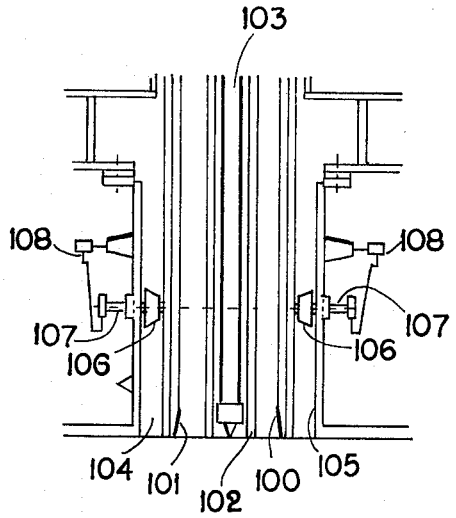

FIG. 13—a fifth vortex burner for the reactor after FIG. 1.

According to FIG. 1, coal, as it is received from the mine, is carried by a conveyor 1 onto a grinder 2 where it is wet ground with water. From the grinder the coal-water slurry passes to a stirrer and container 3. The stirrer 3 insures a consistent and good distribution of coal in the water.

From the stirrer and container 3 the coal-water-slurry is sucked by a pump 4 and pushed by a pipe 5 into a vortex burner 6. In addition a pipe 7 is connected to the vortex burner 6 for the combustive air and/or pure oxygen.

The vortex burner 6 rests at the upper side of a reactor 8. The reactor is longitudinal in form with a passage extending longitudinally for the combustible material. The reactor 8 is vertical so that the coal-water-slurry and the combustive air or oxygen are supplied from the vortex burner 6 from top to bottom into the reactor 8. In reactor 8 a partial oxidation of the coal particles in the presence of water is made possible under an operative pressure between 10 and 200 bar. From this reaction evolve carbon monoxide and synthesis-gas containing hydrogen. At the same time fluid slag particles fall which are discharged at the bottom of the reactor and pass into a radiating boiler 9. In the radiating boiler 9 the slag particles and the synthesis-gas experience a first substantial cooling from the temperature of combustion which for instance lies between 1350° and 1500°.

At the foot of the radiating boiler 9 is a water bath upon which surface the synthesis gas is deflected so that by contact with the water bath an additional cooling takes place. At the same time the entrained solid materials, the slag particles are hurled against the water bath. By contact with the bath surface of the water bath the slag particles are solidified. They sink in the water and collect at the foot of the radiating boiler 9. From there they are discharged intermittently into a lock 10 from which they can be removed without the adverse effect of the pressure in the reactor 8 and the radiating boiler 9.

The synthesis gas deflected in the radiating boiler 9 is passed in a pipe 11 to a convection cooler 12. The convexion cooler 12 provides further cooling of the synthesis gas. To it is connected a washer 13. In the washer 13 the flying dust contained in the synthesis gas is washed. The purified synthesis gas gets out at the top of the washer 13 and is supplied, for instance, as raw material for a chemical plant or as reduction gas of a furnace installation.

The liquid of the wash flows below the washer 13 into a thickener withdraws the liquid of the wash, preferably the water is used, the prevailing portion of the liquid refreshed by recycling is supplied to the washer, while what remains by thickening is forced into the stirrer work via a pump 15 and a feed pipe 16. This feedback serves to condition the coal-water-slurry and to utilize what is left as combustible. In the gasification process, steam is generated in the radiating boiler 9 and in the convection vessel 12, which steam is fed through a collector 17 for a desired use.

Referring to FIG. 2 a vortex burner 6 is shown consisting of concentrically disposed tubes 20 and 21. Both tubes 20 and 21 terminate conically. That is, the outer tube 22 has an inner conical mouthpiece 22 which is sealed with the casing of reactor 8. Mouthpiece 22 is provided on the side which is sealed with the inner wall of the burner with cavities which define cooling passages 23. The cooling passages 23 carry cold water when in operation and reduce the heat stress on the vortex burner. The outer tube 20 consists of two tube sections of different cross-sections put together. The tube section associated with the mouthpiece 22 has a smaller cross-section. Between the two cross-sections there is a conical transition 24. The conical transition 24 with the cross-section reduction has a nozzle effect on the medium which is fed between tubes 20 and 21, in this case the coal-water-suspension. Upon mouthpiece 22 the so accelerated coal-water-suspension experiences an additional acceleration at the exit cone 25.

At the exit cone 25 a strong deflection of the coal-water-slurry takes place which, under the prevailing high exit velocities, has a wearing effect on mouthpiece 22. Such wear is prevented by a conical lining 26 on the mouthpiece 22. The conical lining has the form of a funnel and is inserted in the conical exit or laid upon and by welding or with pins is attached to the mouthpiece 22. The pins can be placed at chosen places and do not need any particular fixation, since the conical lining during operation is applied against the exit cone 25 by the combustible flowing out of mouthpiece 22; e.g., the mouthpiece 22 with the exit cone 25 takes up the load exerted on the lining cone 26. In view of the light load the welding connection for the lining cone 26 can be done merely by spot welding. The lining cone 26 extends in part beyond the mouthpiece 22 and forms a sharp-edged collar 27. This sharp-edge collar 27 has substantial advantages in terms of technical effect on stream for the exiting combustible materials.

The cross-section at the exit for the inserted cone may lie between 20 and 30 m/m. This cross-section at the exit results from a reduced cross-section of $\frac{1}{3}$ to $\frac{1}{4}$ of the cross-section of the tube which prevails between the transition 24 and the exit cone 25. The inclination angle of the exit cone 25 amounts to between 40° and 80° relative to the inner wall of the reactor, or between 10° and 50° relative to the longitudinal axis of the vortex burner.

The different tube sections of the outside tube 20 are, as shown in FIG. 2, welded to each other. It is also possible to use screw and clamp connectors.

The inner tube 21 serves in the present instance to inject oxygen or combustive air. At the front end it is maintained inside the outer tube by four equally distributed peripherally centering pins 28. The centering pins 28 insure that both tubes 20 and 21 are parallel. This is advantageous for a controlled mixing of the injected oxygen or injected combustive air with the injected coal-water-slurry between the tubes 21 and 20.

Tube 21 consists, like tube 20, of different tube sections. The tube sections may be welded to each other or fixed to one another in another fashion. The assumption is that a sealed connection exists in order to prevent an undesired early mixing of oxygen or combustive air with the coal-water-slurry suspension.

At its tip, tube 21 possesses an exit cone 29. The exit cone 29 is in two regards conical; namely, inside and outside. Outside, it has preferably the same inclination as the exit cone 25. However, some deviations up to 20° in both directions are possible.

Because of wear, the exit cone 29 is provided with a relatively thick strong wall. In order to ensure a constant wear when it occurs, a cylindrical exit orifice 30 is provided in the exit cone 28. The length of the cylinder of the exit orifice 30 is equal to $\frac{1}{3}$ to $\frac{2}{3}$ of the cross-section of the opening.

A streamlined body 31 is disposed relative to the exit cone 29 in the direction of the stream of flowing oxygen or combustive air. The streamlined body 31 is intended to prevent losses of stream inside the tube 21. As shown in FIG. 2, the streamlined body 31 has an essentially cylindrical form with round or conical integral ends. This form is given for reason of simiplicity of construction. Ideally the form is the form of a drop with the tip extending toward the opening 30. The blunt end of the streamlined body 31 must be a distance from the end of tube 21 equal to $1\frac{1}{2}$ times to $2\frac{1}{2}$ times the cross-section of the exit opening 30. The maximum cross-section of the streamlined body 31 must be between $\frac{1}{2}$ and $\frac{3}{4}$ the cross-section of the exit orifice 30.

The streamlined body 31 is provided with 3 or 4 equally distributed wings 32 held in tube 21. The wings 32 are preferably welded with the streamlined body 31 and tube 21. These have, for reason of flow requirements, a small cross-section. The small cross-section of the wing 32 gives to the streamlined body 31 only the necessary limited support. This support may be substantially increased by providing, as shown in FIG. 2 in dotted lines 33, wings which essentially are pulled toward the oncoming medium flow. It is equally important according to the system of FIG. 1, that the streamlined body 31 be of the suspended type.

In tube 21 are also disposed two ribs 34 which extend on the inner wall of the tube as a half helix line; e.g., each rib covers the other readily by extending over 180° at the periphery of the inner wall of tube 21. Both ribs 34 run in the same direction and are diametrically opposed; e.g., they are turned at 180° to one another. The ribs are welded to the inner wall or are mounted on the inner wall in a particular way. Their form may be in cross-section rectangular or round or in a chosen other way. Rectangular and round shapes present special advantages.

The number of ribs 34 also may be different. There must be at least one rib 34. When going upward the number of ribs is readily limited by the width of the rib. The length of the rib must at least be as in a sector of 60° and lead to the periphery of a maximum sector of 300°.

The distance of the rib from the end of tube 21 must lie at most between the cross-section and 2½ times the cross-section of the exit orifice.

The distance between the ends of tubes 20 and 21 cannot be smaller than half the cross-section and not larger than double the cross-section of the exit orifice 30 or the exit opening of conical exit 25 or the conical insert 26.

The ribs 34 cause spiralling of the oxygen or combustive air streaming through tube 21. The spiral is determined by the inclination angle of the rbis 34 relative to the longitudinal axis of the tube. The inclination angle amounts according to FIG. 2 to 45°. It could also be between 20° and 70°.

It is essential in order to obtain a sufficient spiralling effect that there is a minimum height of the rib. The minimum height of the rib can be 0.01 times the internal cross-dimension of tube 21. The maximum value of the height of the rib cannot be more than 0.4 times this internal cross-dimension. Advantageously a small height of the rib allows to place the streamlined body 31 in the neighborhood of the rib 34. As a result, any disturbance which could cause a loss of spiral effect which is undesirable is prevented.

The spiral effect which holds the oxygen or the combustive air along the rib 34 depends upon the stream velocity in tube 21. The stream velocity on the other side is determined by the inner transverse dimension of the tube and pressure. Moreover it must be considered that a certain volume of oxygen, or air volume, must be supplied in relation with the coal-water slurry.

The ratio of oxygen volume to coal-water-slurry volume amounts between 5 and 15. In case combustive air is used, the volume ratio is of 25 to 75.

With a burner such as shown in FIG. 2, the order of magnitude which is fit for a reactor efficiency between 5.000 $m^3/h$ and 1500 $m^3/h$ becomes, for volume ratios and cross-dimension ratios of the tube as well as exit orifice of the tube, an oxygen velocity between 50 m/sec. and 150 m/sec. Moreover the starting point is a transverse dimension of the tube 21 which is equal to 1.2 to 2 times the diameter of the exit orifice 30.

The coal-water-slurry has a relatively small velocity. It moves with 1 m/sec. to 2 m/sec. in the interspace between tubes 20 and 21. As a result of the much higher gas velocity of oxygen or the combustive air, the coal-water-slurry passing in particle form in the mouth-piece is entrained by the air or oxygen. At the same time the spiralling motion of the air or oxygen is imparted to the entrained particles of coal-water-slurry. Therefore, the combustible material is ejected with a spiral from the vortex burner and moves along a spiralling trajectory across the reactor 8. The spiral trajectory is much longer than a straight trajectory in the longitudinal direction of the reactor. The charging material has consequently a longer stay in the reactor, thus ensuring a more extensive combustion.

In order to hold to a minimum the danger of wear on the walls of the reactor by a sufficient distance at which the particles are moving across the reactor, according to FIGS. 3–5, instead of a fixed pitch, like FIG. 2, a variable pitch is provided and adjustment of the necessary spiral is done in consideration of the desired combustion. The adjustable ribs are referred to as 40. It consists of plates which like ribs 34 are formed like a thread running along the inner wall of the tube. Ribs 40, like ribs 34, are cut from flat plates as half-rings and pulled to receive the desired spiral form. Ribs 34 and 40, however, might also be bent into a spiral from a straight length. This may be made more easy by cutting slits in the plates 40, as shown in dotted lines transversely of the direction of the rib, in the rib at chosen distances, conveniently at the same distance. Depending upon the width of the rib 40 and the depth of the slit 41, a single slit 41 can be sufficient, to provide the desired easiness of adjustment of the rib. The slits are created by boring at the end of the slit and by cutting through the rib up to the boring. With ribs 40 which consist of spring metal, this work is effected before the heat treatment of the material required for such spring characteristics.

In order to obtain a vortex effect according to the invention with the ribs 40 it is not necessary that the ribs be precise all along the inner wall. Different bendings, for instance, at the slits 41, are not damaging. The ribs 40 can as well be without possible adjustment.

It is necessary to have a ready means of fixation of the rib, preferably at the upper and lower ends. At the upper end, the ribs possess bent tongues 42, with which they grip into recesses 43. The recesses 43 are in an inner collar of tube 45. Tube 45 except for inner collar 44 is identical to tube 21. The inner collar 44 can be formed onto tube 45 by casting of a tube. Otherwise a collar can be provided by welding a ring. The welded ring in particular permits a simple fabrication of recesses 43. Before welding the ring the recesses 43 are easily machined into the collar. Instead of machining, they can be manufactured by boring and sawing the ring down to the bore.

At the lower end 46 the ribs rest in a groove pertaining to an annular nut 47. The annular nut 47 is mounted on a tube section of tube 45, which in contrast to tube 21 is provided additionally with an inner thread. In consideration of the light wear due to the flowing oxygen or combustive air, the inner thread referred to as 48 can be open. If necessary the inner thread may be covered. This is achieved with the assist of a collar 49 of the annular nut 47 shown in dotted line. Between the collar 49 and the inner thread 48 remains simply a gap required for moving axially the annular nut.

Adjustment of the annular nut 47 in the axial direction causes a change of distance of nut 47 with respect to to the collar 44 in tube 45. The rib 40 adjusts itself to it, in that the end 46 in the groove referred to as 50 in the annular nut 47 glides peripherally. As a result another pitch is formed and the ribs 40 are maintained at the upper end in the recesses 43 of the inner collar 44. The ribs are prevented from outer radial movement by the tube 45 or the annular nut 47. Radial movement to the inside does not require any additional stopping means when using the streamlined body 31, since the streamlined body 31 at least prevents the rib from gliding out of the annular nut 47 or from being dislodged from recesses 43 and a different position of ribs 40 in the radial direction in the interspace between tube 45 and the streamlined body 31 is not damageful.

If the tube 45 does not have a streamlined body 31 inserted, ribs 40 are prevented from gliding off by closing the recesses 43 in the radial direction and by a tongue and groove at the lower end 46 of the rib. Closing of the recesses 43 can be made with the assist of a ring 51, shown in dotted line in FIG. 3 and welded to the inner collar 44 or in a special way attached. The added tongue at the lower end is referred to as 53 and is shown in dotted line. Moreover an annular groove 54 is shown in dotted line running circularly. The annular groove 54 appears in FIG. 5 below the resting edge of rib 46. It does not prevent a displacement of rib 40 when the annular nut 47 is adjusted.

The annular nut 47 is adjusted with a wrench which engages through teeth the holes 52 of the annular nut 47. The holes 52 are regularly distributed in chosen number on the annular nut. After adjustment the annular nut 47 is blocked by a counter nut 55. The counter nut 55 has, like the annular nut 47, a number of holes 52 regularly distributed. The holes 52 are preferably at the same distance, so that the same wrench can be used for both nuts 47 and 55 despite the different diametral disposition. The teeth of the wrench have thus a distance which is equal to the distance between holes.

When the annular nut 47 possesses a collar covering the inner thread 48 in tube 45, the annular nut has also one collar, not shown, extending downwards.

The ribs 40 are so designed that the deformation that they experience by adjustment stays in the elastic region. This ensures the same original conditions upon each return. Moreover, permanent deformations are not damageful so long as the ends 46 of the ribs 40 at least after each adjustment rest on the annular nut 47 due to the operating pressure of the flowing oxygen or the flowing combustive air. At the upper end the ribs are so maintained that the tongues 42 are hooked by a bent extension 56 in the recess 43. The recess 43 has thus, as shown in FIG. 4, a section which is angular in shape. With a recess resulting from a bore, the diameter of the bore being larger than the slit requiring boring, the ribs 40 are maintained readily by bending.

According to FIGS. 6 and 7, a tube 60 is used instead of tube 45. The ribs have a round cross-section. They are made with wire and at either ends bending is provided. The ribs referred to as 61 are, like the ribs 40, adjustable and impart to the flowing combustive air or flowing oxygen, a sufficient spiral movement. The ribs 64 are, like ribs 40, maintained and adjusted at the lower end by an annular nut 47. Thus, ribs 61 possess at the lower end vertical bends downward which grip into the annular groove 54.

Ribs 61 possess at the upper end bends which are oriented radially and outwardly, which grip in pigeon holes 62 of the tube 60. The pigeon holes 62 face each other diametrically in the inner wall of the tube and well at the place corresponding to the recesses 43.

Adjustment of ribs 40 and 61 from the lower end of tubes 45 and 60 either requires dismounting of the tube or still operation of the reactor to accomplish it from inside the reactor.

When there is weak cooling of the point of the vortex burner and a higher heat load on the adjustment system consisting of the annular nut 47, the counter nut 55 and the inner thread 48, adjustment can also be accomplished from above downward. The ribs then are fixed at the lower end and are adjusted from the upper end by corresponding rotations of an annular nut and counter nut arrangement. In such case this means rotation of a system of annular and counter nuts and a corresponding inner thread above the inner collar 44 or the pigeon holes 62.

FIG. 8 shows a vortex burner in cross-section while making adjustment of the vortex burner operation.

With this vortex burner the tube corresponding to the outside tube 20 is referred to as 70. This tube at the upper end is provided with a central flange 71. Tube 70 also exhibits laterally of the upper end a connecting flange 72 for the admission of coal-water-slurry. The central flange 71 is by construction represented with a removable cap. It possesses a central opening in which a tube 73 is mounted to seal and which can glide as well as turn in place. For adjustment, the tube is provided with an outer thread 74. The outer thread 74 engages the inner thread of the flange 71.

Tube 73 glides into a larger tube 75 disposed coaxially with tube 70. Tubes 73 and 75 form a tube corresponding to inner tube 21; however in several sections which can glide one into the other, the lower section corresponding to the lower end of tube 21 with small dimensional differences. One distinction relative to tube 21 is that tube 75 is maintained in tube 70 by centering pin 28 registered with an abutment 76. Tube 75 stands with the centering pins 28 on the abutment 76. A desired locking is provided above with the assist of releasable snap rings or spring rings. The rings are mounted into a groove disposed in tube 70 above the centering pin 28, and they prevent tube 75 from moving when, by friction tube 73 moves forward. In particular, the snap ring allows a simple mounting with tension tongs available commercially. These tongs grip into holes of the spring of the snap ring so that with a correspondingly wide slit the ring lightly applies pressure and can move in and out of tube 70.

Tube 75 surrounds ribs designated by 77 in the instance, which are also mobile. There are two ribs which are maintained between tube 73 and an abutment 78 of tube 75. Ribs 77 are relative to each other like ribs 40 and 61. Like ribs 40, ribs 77 are made of plates, e.g., they have a rectangular cross-section. In order to reduce the loss of stream occasioned by the fixation of the ribs 77, an outside lip covers the ribs 77 only a few mm. from tube 73 and the abutment 78. This is equally important with a relatively small tube cross-section, when the tube 73 has an integral cross-section. This does not exclude the use of other thicknesses in cross-section in other zones of tube 73, in particular opposite connecting flange 72.

Figure 9:
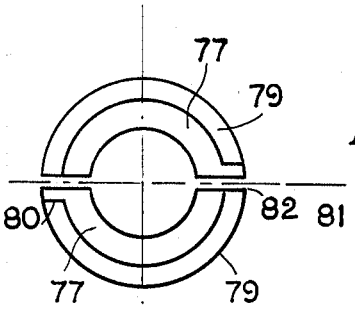
Figure 10:
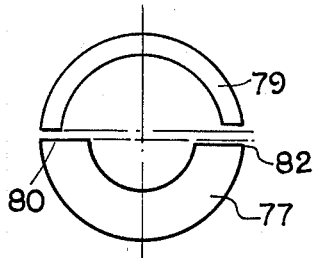
Figure 11:
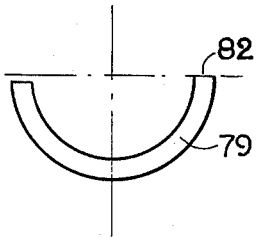

The particular form of rib 77 simplifies substantially readying of the vortex burner with movable ribs and gives to the ribs sufficient hold in tube 77 without any streamlined body 31. The particular form of ribs 77 is characterized in that in the view following FIG. 8, they look like spiral springs and in the view following FIG. 9 they have only the half cross-section of spiral springs; e.g., ribs 77 form an arch along the inner wall of the tube like the other ribs 40 and 61, while a tongue 79 closes itself at the upper and lower ends and extends over half of the area. FIG. 9 shows from above both ribs 77, one opposite the other. FIGS. 10 and 11 show details of one particular rib 77. After that, a tongue 79, closes itself at the upper end 80 of the rib 77 as shown in FIG. 9 beneath line 81, which tongue with the tracing of FIG. 10 runs clockwise, but which by bending around the associated rib 77 runs counter-clockwise according to FIG. 9. At the lower end 82 of the corresponding rib 77 the tongue closes itself as shown in FIG. 11, which also, like shown in FIG. 11, runs clockwise.

The two upper tongues 79 of the two ribs complete each other to form a ring. Similarly the two lower tongues 79 of the two ribs together form a ring. The two ribs 77 thus are maintained by the upper ring and the lower ring of tongues 79. When adjusting the ribs 77 by axial displacement of tube 73, a necessary adjustment of the rib ends to the changed distance is accomplished by turning the rings.

As above explained, the two ribs 77 form, with the associated tongues 79 in the plane view of FIG. 9, segments of half circle. For as far as more than two ribs have to be used, the ribs form with their associated tongues other segments, only this time the segments extend no longer over 180° but rather over 120°. When increasing the number of ribs, the angle of the segment reduces in the plane view.

Figure 12:
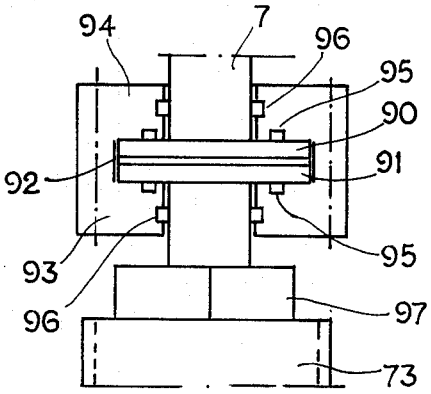

In FIG. 12 the necessary locking system for adjusting the tube 73 is shown. It follows from this that the pipe leading to tube 73 for oxygen or combustive air is a flexible pipe or is articulated, in order to accommodate the longitudinal motion of tube 73.

Conduit 7 possesses at the extremity a flange 90 which faces a flange 91 belonging to the end of tube 73. Between the two flanges 90 and 91 is a gliding disc having an opening for passing the flowing oxygen or combustive air from conduit 7 into tube 73. The two flanges 90 and 91 are surrounded by separate half casings 93 and 94.

The half casings 93 and 94 are tightly assembled to each other; e.g., screwed tightly to one another. The fact that the casing is in two parts is to allow their mounting upon conduit 7 or flange 91. In half casings 93 and 94 are provided sealing rings 95 and 96 which ensure a seal between conduit 7 and half-casing 94 or between flange 91 and half-casing 93.

For adjustment a six-sided bolt member is provided between flanges 91 and the end of the tube. Tube 73 can be adjusted by a conventional wrench coupled on the six-sided bolt member.

In FIG. 13 is shown a vortex burner with a central admission of coal-water-slurry. The central admission is made by a tube 100. Tube 100 is provided with guide plates 101 which orientate the flow of coal-water-slurry along straight lines. Tube 100 surrounds another tube 102 which serves as the admission tube for a firing burner 103. The firing burner 103 consists, for instance, of a gas burner.

With a central admission of the coal-water-slurry the oxygen or combustive air, in contrast to the vortex burner of FIGS. 2–12, is admitted by a conduit 104 which surrounds the conduit of coal-water-slurry. Conduit 104 is formed by tube 100 and a tube 105 surrounding concentrically tube 100. The function of conduit 104 is like the one of tube 70, and the function of the conduit for coal-water-slurry is like the one of tube 73.

In the conduit 104 are disposed guiding plates 106 which can be swung. The guiding plates 106 are mounted for rotative movement on bolts 107 which extend transversely of outer tube 105, or which are mounted in the outer tube 105, for rotative movement on their side. When the guiding plates 106 are fixed on bolts 107, rotation of the bolts causes the guiding plates to swing. Rotation of the bolts can be done, for instance, by hand. Also the bolts are fixed in any position by rotation with a bar 108. The bar 108 is movably mounted outside tube 105 and can so cooperate with a plurality of boreholes distributed around bolts 107 that when the bar is stuck into one borehole it is prevented from rotating further.

The guide plates 106 for any position cause a spiralling effect on the stream of combustive air or oxygen.

We claim:

1. A reactor for coal gasification wherein partial oxidation of a solid material containing carbon in the presence of water produces a carbon monoxide and hydrogen containing gas, comprising a vortex burner connected to said reactor having an inner cylindrical conduit for admission of oxygen or combustive air and an outer concentric cylindrical conduit cooperating with said inner conduit to define an annulus for receipt of said solid material and water, and generally inwardly projecting guide means comprising helical ribs inclined relative to the longitudinal axis of the inner conduit and disposed within said inner conduit for establishing generally spiral motion to said oxygen or combustive air as it moves through said inner conduit wherein said ribs are at one end connected by articulation with said inner conduit and are glidingly supported at the other end in a recess of an annular nut which nut is adjustably connected to said inner conduit at the inner periphery thereof.

2. The reactor of claim 1 characterized in that the ribs are rectangular or round in cross-section.

3. The reactor of claim 2 characterized in that the inclination of the ribs amounts to between 20° and 70° relative to the longitudinal axis of the conduit.

4. The reactor of claim 1 characterized in that the ribs have a length corresponding to a half-pitch distance.

5. The reactor of claim 4 including the ribs extend in the radial direction on a length or breadth which is equal to 0.01 times to 0.4 times the diametral dimension of said inner conduit.

6. The reactor of claim 1 including said outer conduit for solid materials ends in a conical tip and/or said inner conduit for the oxygen or the combustive air has a conical tip.

7. The reactor of claim 6 characterized in that the conduit for the solid material across the conical tip is reduced in diametral dimension to $\frac{1}{3}$–$\frac{1}{4}$.

8. The reactor of claim 7 including providing an inclination angle of between about 40° and 80° between the outer conduit tip transversely of the running longitudinal axis of the outer wall of the vortex burner.

9. The reactor of claim 8 including the diametral dimension of the exit of the vortex burner being between about 18 and 30 mm.

10. The reactor of claim 9 including the tip of the inner conduit for the oxygen or the combustive air deviates in its conicity by a maximum of 20° from the inclination angle of the conicity of the outer conduit tip.

11. The reactor of claim 10 characterized by a cylindrical orifice in the conical tip of the conduit for oxygen or the conduit for combustive air, the length of which is equal to one-third to two-thirds of the orifice diameter of the outer conduit tip.

12. The reactor of claim 1 including said inner conduit in the zone before the outlet tip thereof has 1.2 to 2 times the diameter of the cylindrical exit orifice at the outlet tip thereof.

13. The reactor of claim 12 including the tip of the inner conduit for the oxygen or the combustive air has a distance from the exit orifice of the vortex burner which is equal to 0.75 to 1.6 times the diameter of the exit orifice.

14. The reactor of claim 13 including a streamlined body disposed in the conduit for the oxygen or the combustive air.

15. The reactor of claim 14, characterized by a suspension arrangement for the streamlined body.

16. The reactor of claim 15 characterized in that the streamlined body is disposed in the zone of the ribs.

17. The reactor of claim 1 including a conical insert at the exit orifice of the vortex burner.

18. The reactor of claim 17 characterized by a projecting sharp breaking collar at the exit tip of the conical insert.

* * * * *